US008480767B2

(12) United States Patent
Matsuzawa et al.

(10) Patent No.: US 8,480,767 B2
(45) Date of Patent: Jul. 9, 2013

(54) FLUIDIZED BED GASIFICATION SYSTEM

(75) Inventors: Yoshiaki Matsuzawa, Koto-ku (JP); Toshiyuki Suda, Koto-ku (JP); Hironobu Fujiyoshi, Koto-ku (JP); Makoto Takafuji, Koto-ku (JP); Kenichiro Kondo, Koto-ku (JP)

(73) Assignee: IHI Corporation, Tokyo (JP)

( * ) Notice: Subject to any disclaimer, the term of this patent is extended or adjusted under 35 U.S.C. 154(b) by 971 days.

(21) Appl. No.: 12/530,789

(22) PCT Filed: Mar. 14, 2007

(86) PCT No.: PCT/JP2007/000219

§ 371 (c)(1),
(2), (4) Date: Sep. 11, 2009

(87) PCT Pub. No.: WO2008/111127

PCT Pub. Date: Sep. 18, 2008

(65) Prior Publication Data

US 2010/0043683 A1 Feb. 25, 2010

(51) Int. Cl.

| | |
|---|---|
| ***B01J 7/00*** | (2006.01) |
| ***B01J 8/18*** | (2006.01) |
| ***C01B 3/36*** | (2006.01) |
| ***C01B 6/24*** | (2006.01) |
| ***C10J 3/00*** | (2006.01) |

(52) U.S. Cl.
USPC ..... 48/61; 48/197 R; 48/210; 423/644; 422/139

(58) Field of Classification Search
USPC ..... 48/61, 197 R, 210; 422/139
See application file for complete search history.

(56) References Cited

U.S. PATENT DOCUMENTS

| | | | | |
|---|---|---|---|---|
| 2,515,155 | A * | 7/1950 | Munday | 55/343 |
| 2,912,315 | A * | 11/1959 | Haney | 48/214 R |
| 3,890,111 | A * | 6/1975 | Knudsen | 48/197 R |
| 3,891,402 | A * | 6/1975 | Nahas et al. | 48/197 R |

(Continued)

FOREIGN PATENT DOCUMENTS

| | | |
|---|---|---|
| DE | 3339260 A1 | 5/1984 |
| GB | 2 131 317 A | 6/1984 |
| JP | 53-10565 | 1/1978 |
| JP | 57-48895 (U) | 3/1982 |
| JP | 2005-41959 | 2/2005 |

OTHER PUBLICATIONS

U.S. Appl. No. 12/999,163, filed Dec. 15, 2010, Matsuzawa, et al.

(Continued)

*Primary Examiner* — Matthew Merkling
(74) *Attorney, Agent, or Firm* — Oblon, Spivak, McClelland, Maier & Neustadt, L.L.P.

(57) ABSTRACT

A fluidized bed gasification system is provided in which bed material and raw material are passed throughout a fluidized bed gasification furnace so that raw material is gasified with higher gasification efficiency to improve gasification productivity. A heat-resistant partition 32 for regulation of bed material flow is arranged between positions I and II of a downcomer 12 of a separator 8 and of a supply flow passage 25 in plane of a fluidized bed gasification furnace 2. As a result, the bed material introduced via the downcomer 12 is directed to a supply flow passage 25 through a circuitous flow passage 33 throughout the fluidized bed gasification furnace 2 defined by the heat-resistant partition 32.

15 Claims, 9 Drawing Sheets

U.S. PATENT DOCUMENTS

| | | | | | |
|---|---|---|---|---|---|
| 3,957,459 | A | * | 5/1976 | Mitchell et al. | 48/197 R |
| 3,985,519 | A | * | 10/1976 | Kalina et al. | 48/202 |
| 4,211,606 | A | * | 7/1980 | Ponomarev et al. | 201/12 |
| 4,259,088 | A | * | 3/1981 | Moss | 48/212 |
| 4,391,612 | A | * | 7/1983 | Chang | 48/202 |

OTHER PUBLICATIONS

Office Action issued on Nov. 9, 2011 in the corresponding German Patent Application No. 112007003362.2.

* cited by examiner

FLUIDIZED BED GASIFICATION SYSTEM

TECHNICAL FIELD

The present invention relates to a fluidized bed gasification system for gasifying raw material by means of a fluidized bed.

BACKGROUND ART

There has been proposed a fluidized bed gasification system for gasification of raw material such as coal, biomass or sludge wherein raw material is supplied to a fluidized bed gasification furnace preliminarily supplied with hot bed material or fluid medium, a gasification agent being supplied to form a fluidized bed to thereby gasify the raw material, resultant produced gas being taken out outside while the bed material and char produced upon the gasification in the gasification furnace are supplied to a fluidized bed combustion furnace for heating of the bed material through fluidized combustion of the char, the heated bed material being supplied again to said fluidized bed gasification furnace (see, for example, Reference 1).

FIG. 1 shows a fluidized bed gasification system disclosed in the above Reference 1. In FIG. 1, reference numeral 1 denotes a fluidized bed combustion furnace into which the bed material and char produced upon gasification of raw material 26 in a fluidized bed gasification furnace 2 are introduced from below, air supplied from an air pipe 4 being blown through a bottom wind box 3. The char and bed material are fluidized and raised by the blown air and are burned and heated, respectively, while they are raised. Reference numeral 5 denotes a supplementary fuel port for supplying supplementary fuel for heating to a fluidized bed in the fluidized bed combustion furnace 1; 6, a heat exchanger for heat recovery arranged in an upper portion of the combustion furnace 1.

The upper portion of the fluidized bed combustion furnace 1 is connected through a transfer pipe 7 to a separator 8 comprising a cyclone. The separator 8 has outer and inner cylinders 9 and 10, hot fluid including bed material from the fluidized bed combustion furnace 1 being introduced via the transfer pipe 7 tangentially into the outer cylinder 9 where it is centrifuged into the bed material and exhaust gas. The exhaust gas with fine-grained ash is discharged through the inner cylinder 10 while the bed material 11 with rough-grained unburned char is supplied to a fluidized bed gasification furnace 2 via a downcomer 12 extending downward from a lower end of the outer cylinder 9 in the separator 8.

The fluidized bed gasification furnace 2 comprises an introductory portion 13 for introduction of the bed material 11 separated in the separator 8 through the downcomer 12, a gasification portion 15 for gasification of raw material 26 from a raw material supply device 14 through heat of the bed material 11, a communicating portion 17 for supply of the bed material 11 in the introductory portion 13 through a fluidized bed 16 to the gasification portion 15 and a gasification agent box portion 18 extending over bottoms of the portions 13, 17 and 15 for supply of the gasification agent such as steam into the fluidized bed gasification furnace 2 and connected with a gasification agent supply line 19. The separation of the introductory and gasification portions 13 and 15 in the fluidized bed 16 by the communicating portion 17 as shown in FIG. 1 prevents the burnt gas in the fluidized bed combustion furnace 1 from flowing back through the fluidized bed gasification furnace 2 into the separator 8.

The bed material and the char not gasified in the gasification portion 15 are supplied for circulation to the fluidized bed combustion furnace 1 via a supply flow passage 25 comprising for example an overflow pipe, the bed material being then heated again by the combustion of the char.

When coal is supplied as raw material 26 to be gasified to the gasification portion 15, produced is produced gas 20 mixed with gas components such as hydrogen ($H_2$), carbon monoxide (CO) and methane ($CH_4$); when biomass or the like with a high water content is supplied as raw material 26 to be gasified, produced is produced gas 20 with the above-mentioned gas components containing much steam. The produced gas 20 is taken out via a discharge pipe 21 from the fluidized bed gasification furnace 2 into a recovery device 22 where the produced gas 20 is separated from impalpable powder 23 having been entrained in the gas and is taken out through an inner pipe 24. The produced gas 20 thus taken out may be pressurized and supplied as fuel to, for example, a gas turbine, or may be supplied to a refinery for production of any target gas from the produced gas 20.

[Reference 1] JP 2005-41959A

SUMMARY OF THE INVENTION

Problems to be Solved by the Invention

Preferably, the fluidized bed gasification furnace 2 has a rectangular section from a viewpoint of saving in materials required. However, the rectangular section brings about a problem that, as shown in FIG. 1, the bed material 11 supplied to the fluidized bed gasification furnace 2 from the separator 8 via the downcomer 12 cannot move throughout the plane of the fluidized bed gasification furnace 2. This problem tends to become marked as fuel treatment scale in the fluidized bed gasification system is enlarged, since the fluidized bed gasification furnace 2 is required to be increased in size.

More specifically, as shown in FIG. 2 which is a plan view of the system in FIG. 1, the bed material 11 from the separator 8 is supplied through the downcomer 12 to the introductory portion 13 of the fluidized bed gasification furnace 2 at a point or position I, so that the bed material 11 supplied to the introductory portion 13 is allowed to move from the position I to a position II of the supply flow passage 25 via a shortest course 27. Thus, produced laterally of the shortest course 27 between the positions I and II are dead spaces 28 where movement of the bed material 11 is stagnant and cannot reach every corner. As a result, a problem occurs that the unburned char entering into the fluidized bed gasification furnace 2 cannot reach every corner of the furnace and leaves before lapse of necessary time for the reaction. The stagnant movement of the bed material in the dead spaces 28 lowers the temperature of the bed material, which tends to be further promoted by the fact that the dead spaces 28 are inherently cooled by outer walls 2' of the fluidized bed gasification furnace 2.

Thus, the dead spaces 28 produced in the conventional fluidized bed gasification furnace 2 where the movement of the bed material is stagnant bring about the problem of lowering the gasification efficiency of the raw material 26 by the fluidized bed gasification furnace 2.

Moreover, when the raw material 26 is supplied to the fluidized bed gasification furnace 2 at a central position III of the furnace, then the raw material 26 is directed to the supply flow passage 25 together with the bed material moving in the shortest course 27, unreacted char disadvantageously flowing out through the supply flow passage 25, resulting in lowering of the gasification efficiency. When the raw material 26 is supplied to the fluidized bed gasification furnace 2 at a non-central position of the furnace, then there occurs deviation in concentration of the raw material 26 in the fluidized bed gasification furnace 2, also disadvantageously resulting in lowering of gasification efficiency.

On the other hand, in order to guide the hot fluid from the fluidized bed combustion furnace 1 via the transfer pipe 7 to the separator 8, particles such as bed material entrained in the hot fluid must be prevented from being separated and accumulated in the transfer pipe 7 to clog the same, so that the transfer pipe 7 must be as short in length as possible. However, the transfer pipe 7 is disadvantageously long in length in the fluidized bed gasification furnace 2 of FIG. 1 since the bed material 11 is received via the downcomer 12 by the introductory portion 13 away from the fluidized bed combustion furnace 1.

In order to overcome this, as shown in FIGS. 3 and 4, to arrange the separator 8 adjacent to the fluidized bed combustion furnace 1 may be envisaged. In FIG. 4, arranged above lateral corners of the fluidized bed gasification furnace 2 adjacent to the fluidized bed combustion furnace 1 are separators 8 and 8' connected respectively via short transfer pipes 7 and 7' to the fluidized bed combustion furnace 1.

However, in the structure shown in FIG. 4, the bed material 11 supplied via the downcomers 12 to the corners of the fluidized bed gasification furnace 2 adjacent to the fluidized bed combustion furnace 1 is allowed to flow in shortest courses 27 to the supply flow passage 25, so that unreacted char flows out through the supply flow passage 25 and a low-temperatured dead space 28 is produced in the fluidized bed gasification furnace 2 at a position away from the fluidized bed combustion furnace 1 where no bed material moves. This makes temperature in the fluidized bed gasification furnace 2 uneven, disadvantageously resulting in lowering of gasification efficiency of the raw material 26 in the fluidized bed gasification furnace 2.

The invention was made in view of the above-mentioned conventional problems and has its object to provide a fluidized bed gasification system which can gasify raw material with higher gasification efficiency.

Means or Measures for Solving the Problems

The invention is directed to a fluidized bed gasification system comprising a fluidized bed combustion furnace for heating of bed material through combustion of char, a separator for separating bed material from hot fluid from the fluidized bed combustion furnace, a fluidized bed gasification furnace into which raw material is introduced and the bed material separated in the separator is introduced via a downcomer, the raw material being gasified by means of a fluidized bed supplied with a gasification agent to take-out produced gas and a supply flow passage for circulating the bed material and char produced upon the gasification of the raw material in the fluidized bed gasification furnace to a fluidized bed combustion furnace, said fluidized bed gasification system comprising movement regulation means for regulating moving direction of the bed material arranged between arranged positions of the downcomer of the separator and of the supply flow passage in plane of the fluidized bed gasification furnace, whereby the bed material introduced via the downcomer is directed to the supply flow passage via a circuitous flow passage for travel throughout the fluidized bed gasification furnace by the movement regulation means.

In the circuitous flow passage, baffle means may be arranged to seal a top of the circuitous flow passage and extend at its lower end into the fluidized bed to thereby provide a pretreatment chamber including the downcomer, raw material being supplied to the pretreatment chamber for pretreatment of the raw material, the pretreated raw material being passed below the baffle means for guidance through the circuitous flow passage.

The movement regulation means may provide the circuitous flow passage by a heat-resistant partition extending longitudinally in the fluidized bed gasification furnace to partition the fluidized bed.

The movement regulation means may provide the circuitous flow passage by a concavity provided by partly concaving an outer wall of the fluidized bed gasification furnace into the plane of the fluidized bed gasification furnace.

A downstream portion of the circuitous flow passage adjacent to the supply flow passage may be provided with a produced gas take-out port.

The single fluidized bed combustion furnace may be provided with the single separator.

The single fluidized bed combustion furnace may be provided with a plurality of separators.

In the pretreatment chamber, the raw material may be dehydrated to take-out steam.

In the pretreatment chamber, the raw material may be pyrolyzed to take-out pyrolysis gas.

The pyrolysis gas taken out from the pretreatment chamber may be supplied as fuel for heating to the fluidized bed combustion furnace.

Effects of the Invention

A fluidized bed gasification system according to the invention can exhibit an excellent effect of making unburned char in a fluidized bed gasification furnace travel throughout the furnace to attain higher gasification efficiency since movement regulation means for regulating moving direction of bed material is arranged between arranged positions of a downcomer of a separator and of a supply flow passage in the plane of the fluidized bed gasification furnace, the bed material introduced via the downcomer being directed to the supply flow passage via a circuitous flow passage for travel throughout the fluidized bed gasification furnace by the movement regulation means.

EXPLANATION OF THE REFERENCE NUMERALS

Figure 1:
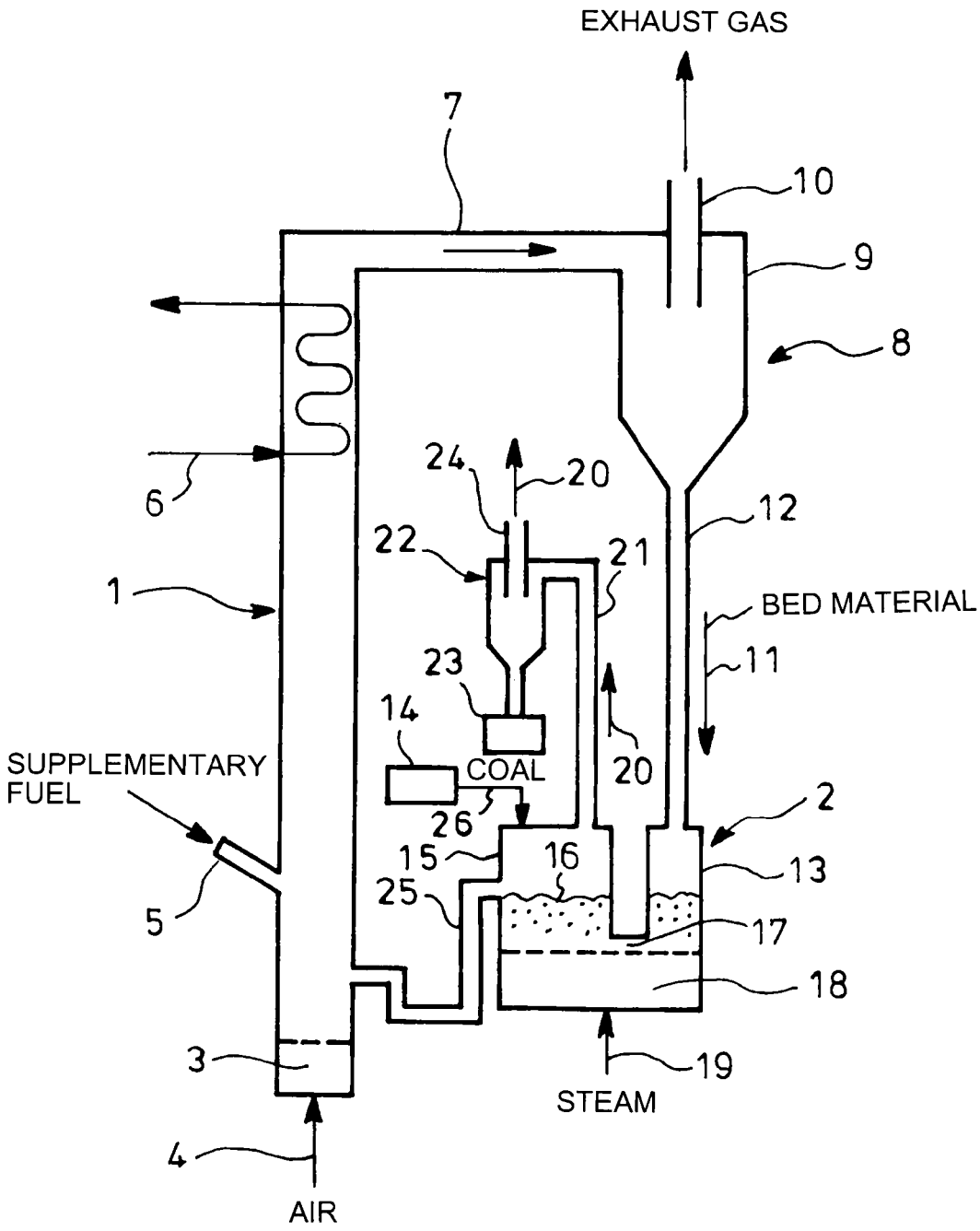
FIG. 1 is a side view showing a conventional fluidized bed gasification system.
Figure 2:
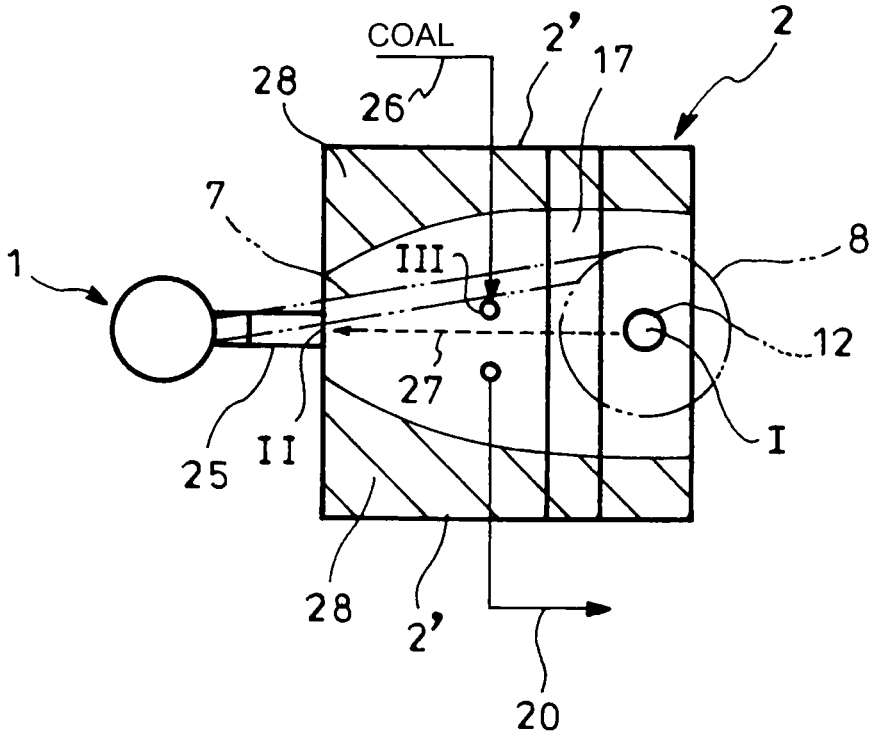
FIG. 2 is a plan view of FIG. 1.

1 fluidized bed combustion furnace
2 fluidized bed gasification furnace
7, 7' transfer pipe
8, 8' separator
11 bed material
12 downcomer
16 fluidized bed
20 produced gas
25 supply flow passage
26 raw material (coal)
26' raw material (biomass)
27 shortest course
32 heat-resistant partition (movement regulation means)
33, 33' circuitous flow passage
34 take-out port
35 concavity
36, 36' baffle means
37, 37' pretreatment chamber
38 pretreated raw material
39 steam
40 pyrolysis gas
41 pretreated raw material
I position of downcomer
II position of supply flow passage

BEST MODE FOR CARRYING OUT THE INVENTION

Embodiments of the invention will be described in conjunction with the attached drawings.

Figure 5:
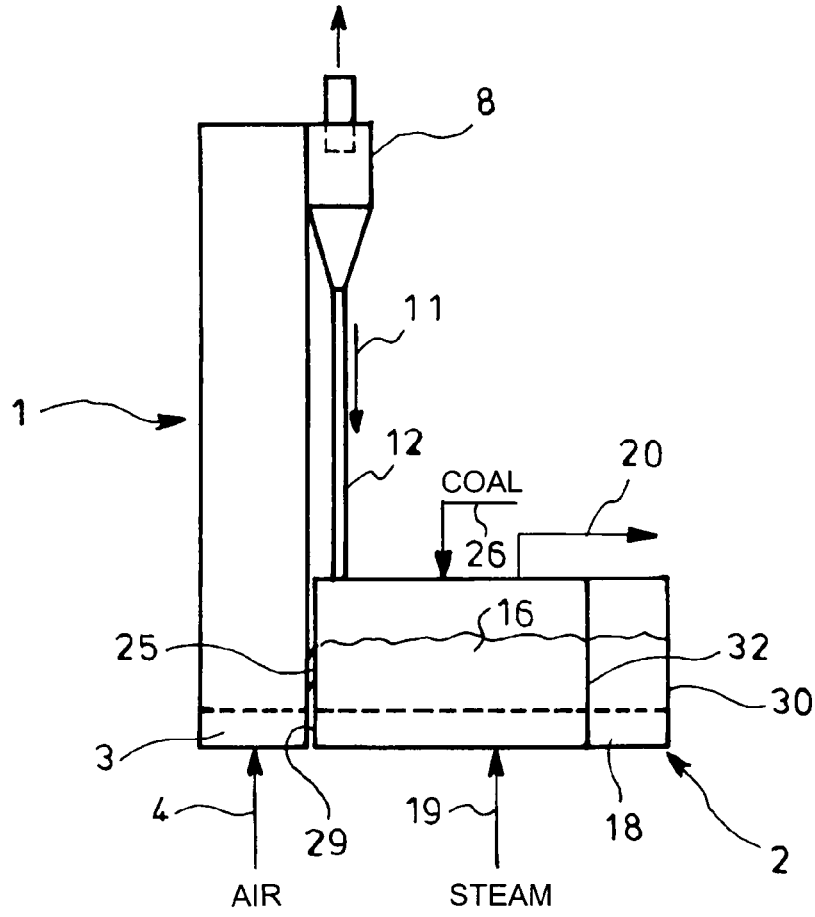
FIG. 5 is a side view showing an embodiment of the invention.
Figure 6:
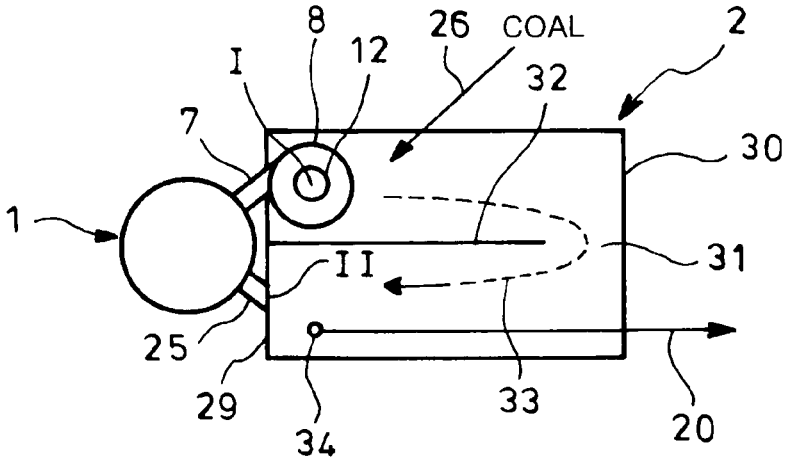
FIG. 6 is a plan view of FIG. 5.

FIGS. 5 and 6 show an embodiment of the invention comprising a fluidized bed combustion furnace 1 for heating of bed material through combustion of char, a separator 8 for separating the bed material 11 from hot fluid from the fluidized bed combustion furnace 1 and a fluidized bed gasification furnace 2 into which raw material 26 is introduced and the bed material separated in the separator 8 is introduced via a downcomer 12, a fluidized bed 16 being formed by supply of a gasification agent such as steam, air or carbon dioxide, the raw material 26 being gasified through agitation with the hot bed material in the fluidized bed gasification furnace 2 so as to take-out produced gas 20, the bed material and char produced upon gasification of the raw material in the fluidized bed gasification furnace 2 being circulated via a supply flow passage 25 to the fluidized bed combustion furnace 1.

The fluidized bed gasification furnace 2 shown in FIGS. 5 and 6 is arranged adjacent to the fluidized bed combustion furnace 1, and is provided with movement regulation means in the form of a heat-resistant partition 32 arranged laterally centrally of the fluidized bed gasification furnace 2 and having a base end fitted to a wall 29 of the fluidized bed gasification furnace 2 adjacent to the fluidized bed combustion furnace 1, a tip end extending toward a wall 30 of the fluidized bed gasification furnace 2 away from the fluidized bed combustion furnace 1 to provide a communicating portion 31 between, an upper end fitted to a top of the fluidized bed gasification furnace 2 and a lower end fitted to a bottom of the fluidized bed gasification furnace 2. Thus, a substantially U-shaped circuitous flow passage 33 is provided in the fluidized bed gasification furnace 2, partitioned by the heat-resistant partition 32 and communicated at the communicating portion 31. Alternatively, the structure may be such that the upper end of the heat-resistant partition 32 is not fitted to the top of the fluidized bed gasification furnace 2 for communication of the gas phase thereat.

The single fluidized bed combustion furnace 1 is connected through a transfer pipe 7 to a separator 8 which has a downcomer 12 connected at its lower end to one end of a substantially U-shaped circuitous flow passage 33 (a right-side end when facing to the fluidized bed combustion furnace 1), the other end of the substantially U-Shaped circuitous flow passage 33 (a left-side end when facing to the fluidized bed combustion furnace 1) being connected through the supply flow passage 25 to the fluidized bed combustion furnace 1. In the figure, reference numeral 34 denotes a produced gas 20 take-out port arranged adjacent to the other end of the substantially U-shaped circuitous flow passage 33.

Thus, provided in the embodiment of FIGS. 5 and 6 is movement regulation means in the form of the heat-resistant partition 32 between arranged positions I and II of the downcomer 12 of the separator 8 and of the supply flow passage 25 in the plane of the fluidized bed gasification furnace 2, respectively, so that the bed material 11 introduced via the downcomer 12 is directed to the supply flow passage 25 via the circuitous flow passage 33 defined by the heat-resistant partition 32 for travel throughout the fluidized bed gasification furnace 2.

Adaptable for the heat-resistant partition 32 provided in the fluidized bed gasification furnace 2 as movement regulation means which requires to withstand a temperature of, for example, around 700° C.-900° C. are various heat-resistant structures such as structure made of fireproof bricks, structure made of metal such as stainless steel and covered with fireproof bricks or water-cooled structure made of stainless steel and supplied with water between.

Figure 7:
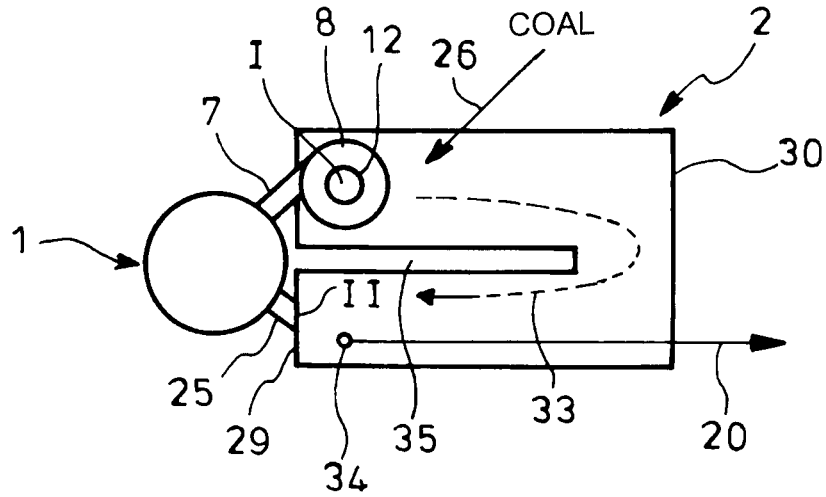
FIG. 7 is a plan view showing a modification of the movement regulation means.

As shown in FIG. 7 as a modification, the movement regulation means may provide the circuitous flow passage 33 by a concavity 35 provided by partly concaving a wall 29 of the fluidized bed gasification furnace 2 into the plane of the furnace 2. Such movement regulation means in the form of the concavity 35 is cooled by ambient air just like the outer surrounding walls of the fluidized bed gasification furnace 2 and therefore may be made of, for example, metal such as stainless steel just like the outer walls.

In the embodiments of FIGS. 5, 6 and 7, the bed material via the downcomer 12 from the separator 8 is caused to flow through the circuitous flow passage 33 by the movement regulation means in the form of the heat-resistant partition 32 or the concavity 35 in or on the fluidized bed gasification furnace 2, so that the raw material 26 supplied adjacent to the downcomer 12 is caused to flow throughout the fluidized bed gasification furnace 2 while satisfactorily agitated with the bed material, and is directed to the supply flow passage 25, whereby no dead spaces exist where the movement of the bed material is stagnant. The raw material 26 introduced via the downcomer 12 is prevented from flowing into the supply flow passage 25 via the shortest course; the raw material 26 is evenly gasified during movement through the circuitous flow passage 33 so that unreacted char is prevented from flow through the supply flow passage 25. Thus, due to this and the like, the gasification efficiency of the raw material 26 in the fluidized bed gasification furnace 2 is remarkably enhanced.

Figure 8:
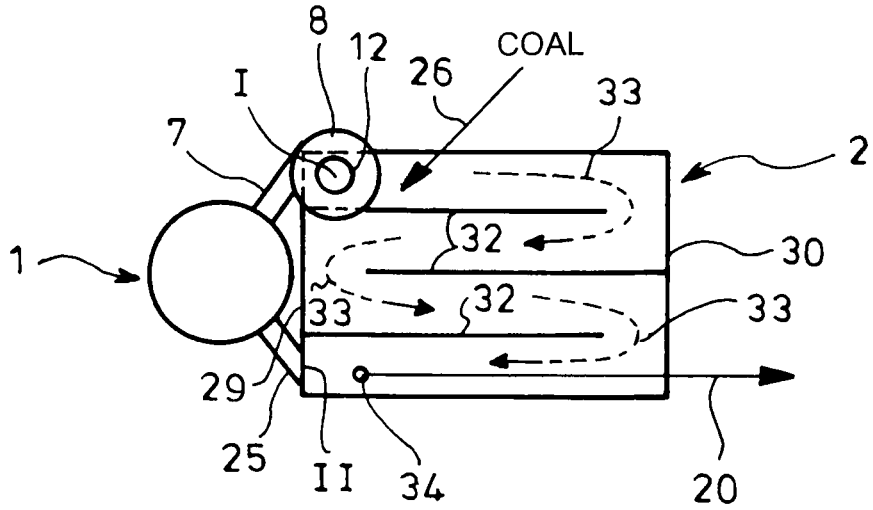
FIG. 8 is a plan view showing a modification of the circuitous flow passage in a zigzag form.

Disclosed in the above embodiments is formation of the U-shaped circuitous flow passage 33 by the movement regulation means in the form of the single heat-resistant partition 32 or concavity 35 in or on the fluidized bed gasification furnace 2. Alternatively, as shown in FIG. 8 as a modification, movement regulation means in the form of a plurality of heat-resistant partitions 32 or the like may be arranged to provide the circuitous flow passage 33 for zigzag movement of the bed material in the fluidized bed gasification furnace 2. According to the circuitous flow passage 33 in the zigzag form, the movement course of the bed material and raw material 26 is prolonged to further facilitate the gasification of the raw material 26.

Figure 3:
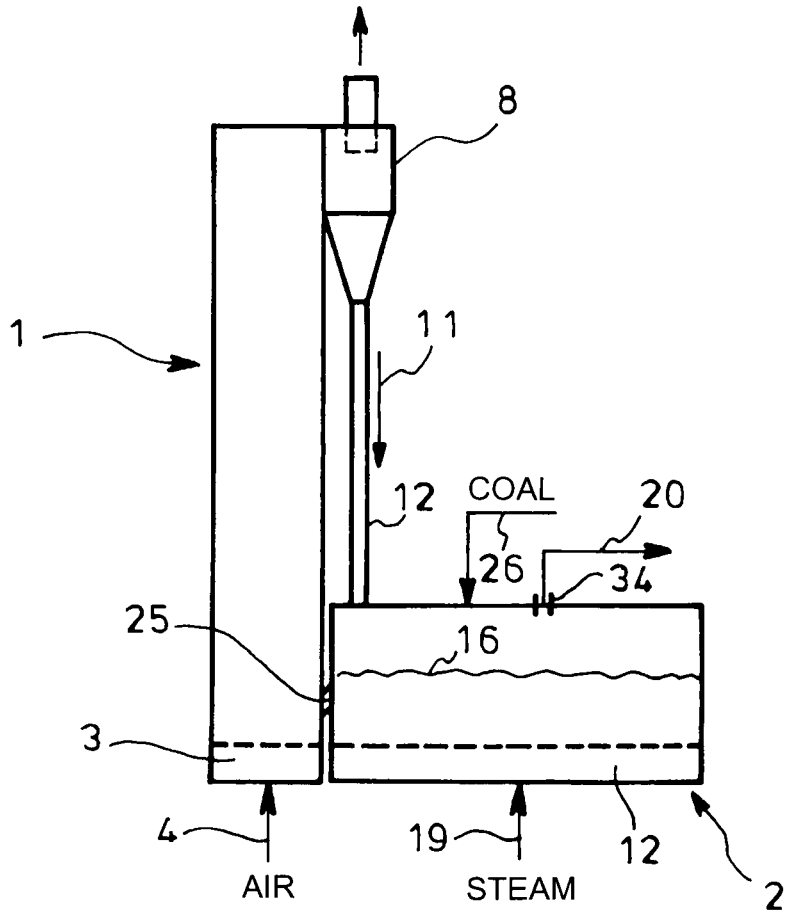
FIG. 3 is a side view showing a further conventional fluidized bed gasification system.
Figure 4:
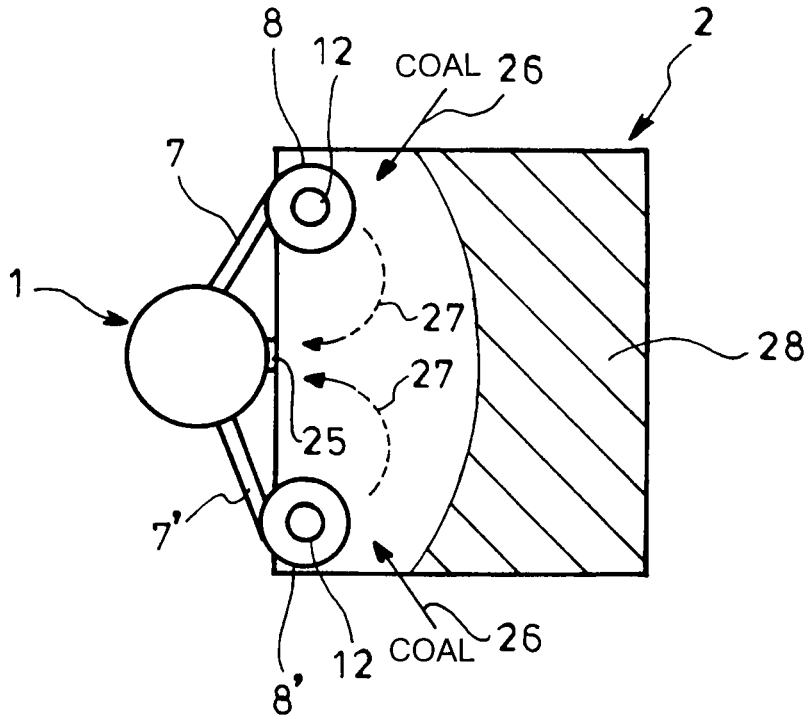
FIG. 4 is a plan view of FIG. 3.
Figure 9:
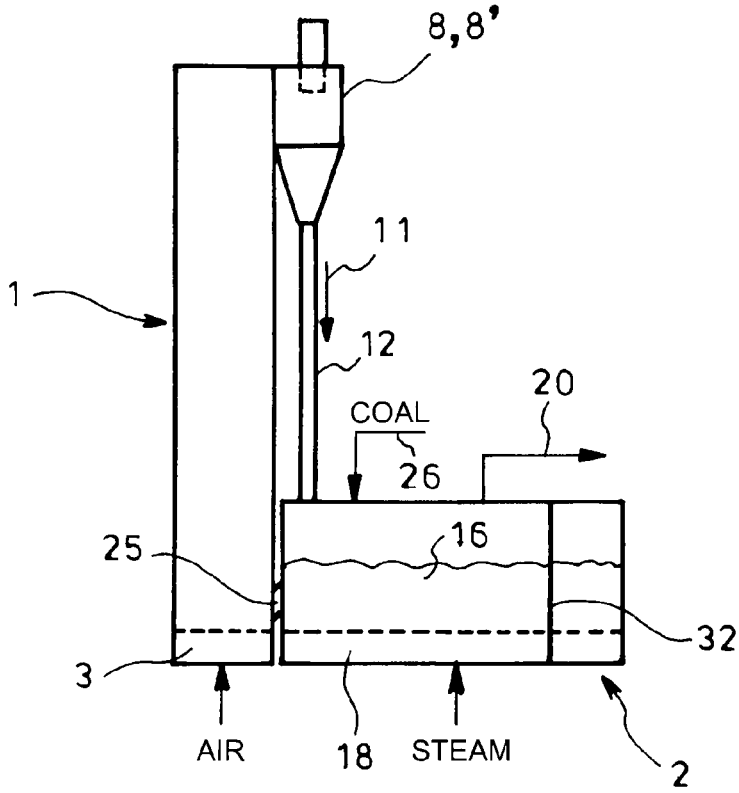
FIG. 9 is a side view showing a further embodiment of the invention.
Figure 10:
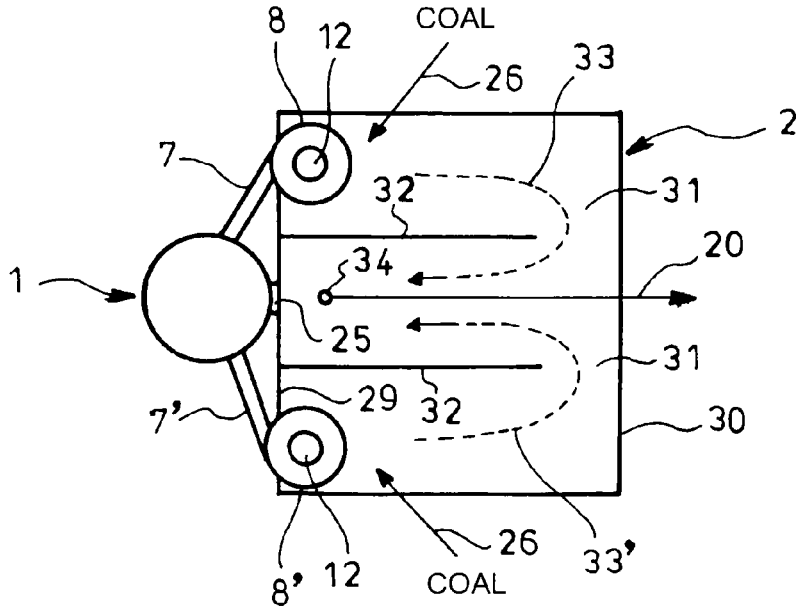
FIG. 10 is a plan view of FIG. 9.

FIGS. 9 and 10 shows a further embodiment of the invention applied to a case where, as shown in FIGS. 3 and 4, a single fluidized bed combustion furnace 1 is provided with two separators 8 and 8'. In this embodiment, two heat-resistant partitions 32 constituting the movement regulation means are arranged oppositely with respect to a supply flow passage 25 and in a laterally spaced apart relationship, each of the partitions 32 having a base end fitted to a wall 29 of the fluidized bed gasification furnace 2 adjacent to the fluidized bed combustion furnace 1, a tip end extending toward a wall 30 of the fluidized bed gasification furnace 2 away from the fluidized bed combustion furnace 1 to provide a communicating portion 31 between. This symmetrically provides substantially U-shaped circuitous flow passages 33 and 33' in the fluidized bed gasification furnace 2 partitioned by the partitions 32 and communicated at the communicating portions 31. Arranged above a right-side end of the circuitous flow passage 33 adjacent to the wall 29 is a separator 8, and arranged above a left-side end of the circuitous flow passage 33' adjacent to the wall 29 is a separator 8'.

According to the embodiment of FIGS. 9 and 10, hot fluid from the fluidized bed combustion furnace 1 is supplied through the transfer pipe 7 and 7' to the separators 8 and 8' where the bed material is separated. The separated bed material 11 is supplied through the downcomers 12 to the right- and left-side ends of the circuitous flow passages 33 and 33', respectively; the bed material moves though the respective circuitous flow passages 33 and 33' in the direction away from the fluidized bed combustion furnace 1 and through the communicating portions 31 and is joined at the center flow passage into the supply flow passage 25. Thus, according to the embodiment of FIGS. 9 and 10, even in the fluidized bed gasification furnace 2 with laterally long width, the bed material is caused to flow throughout in the furnace without stagnancy of the bed material.

Figure 11:
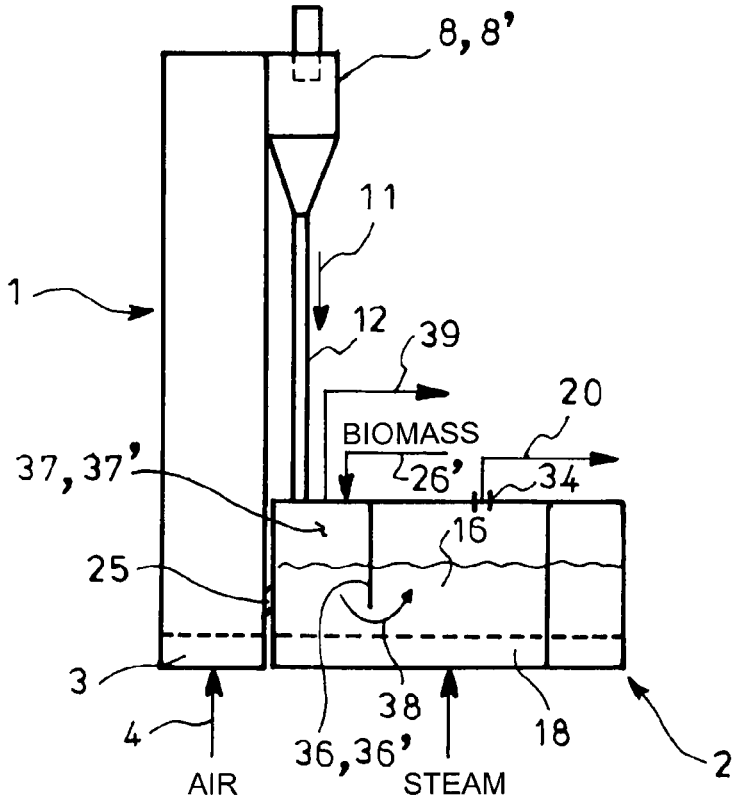
FIG. 11 is a side view showing a still further embodiment of the invention.
Figure 12:
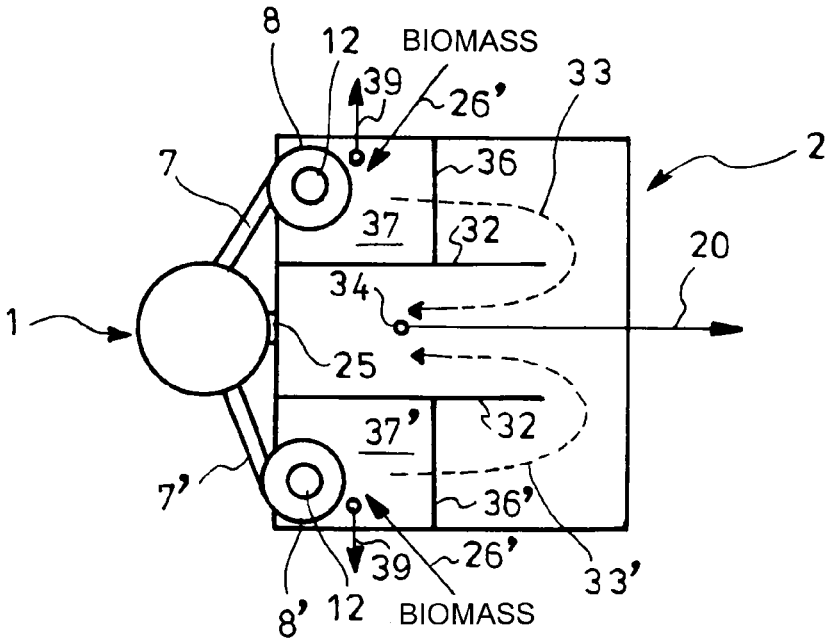
FIG. 12 is a plan view of FIG. 11.

FIGS. 11 and 12 show a still further embodiment of the invention suitable for gasification of raw material 26' such as biomass with a high water content. The embodiment is structurally similar to the above-mentioned embodiment of FIGS. 9 and 10; arranged in circuitous flow passages 33 and 33' adjacent to their right- and left-side ends to a fluidized bed combustion furnace 1 are baffles means 36 and 36', respectively, which seal tops of circuitous flow passages 33 and 33' and extend at their lower ends into the fluidized bed 16, thereby providing pretreatment chambers 37 and 37' each including the downcomer 12. Introduced into each of the pretreatment chambers 37 and 37' are the bed material 11 and the raw material 26' comprising biomass. The baffle means 36 and 36' may be heat-resistant structure just like the heat-resistant partition 32 explained in connection with FIG. 6 or may be provided by the concavities 35 as shown in FIG. 7. In each of the pretreatment chambers 37 and 37', the raw material 26' comprising biomass is supplied to be treated with pretreatment related mainly to dryness or dehydration of the raw material 26', the pretreated dry raw material 38 being passed below the baffle means 36 and 36' for guidance through the circuitous flow passages 33 and 33'.

In the embodiment of FIGS. 11 and 12, raw material 26' such as biomass with a high water content is dehydrated in the pretreatment chambers 37 and 37' and resultant steam 39 is taken out outside. The pretreated dry raw material 38 is passed below the baffle means 36 and 36' for guidance through the circuitous flow passages 33 and 33' so that the pretreated dry raw material 38 is effectively gasified during movement in the circuitous flow passages 33 and 33', the produced gas 20 free from the steam 39 being taken out through the take-out port 34.

Figure 13:
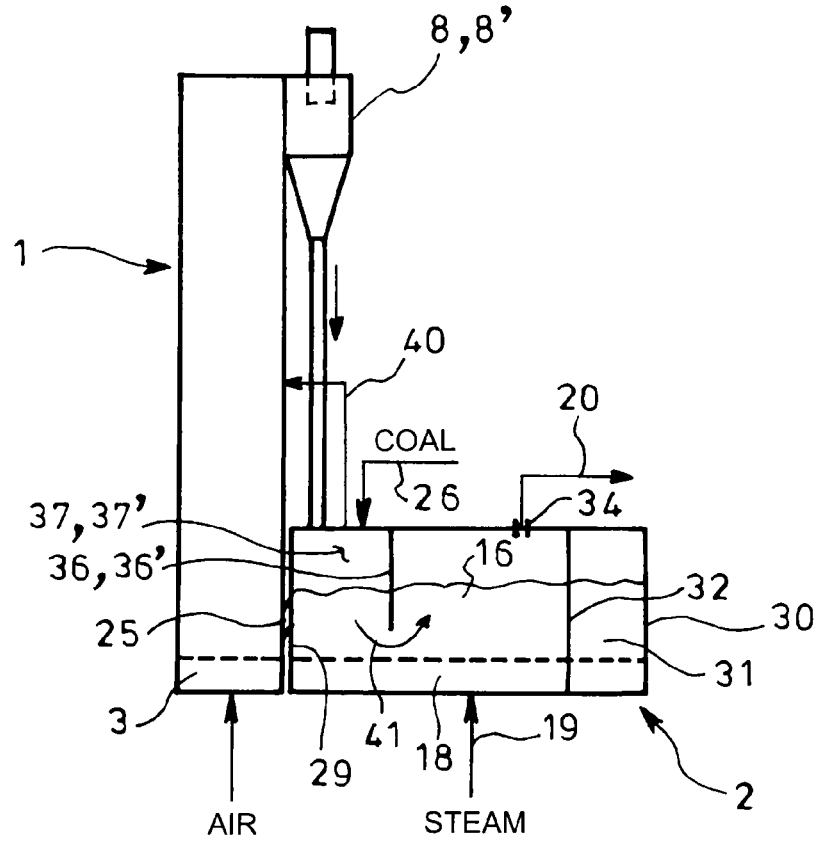
FIG. 13 is a side view showing a still further embodiment of the invention.
Figure 14:
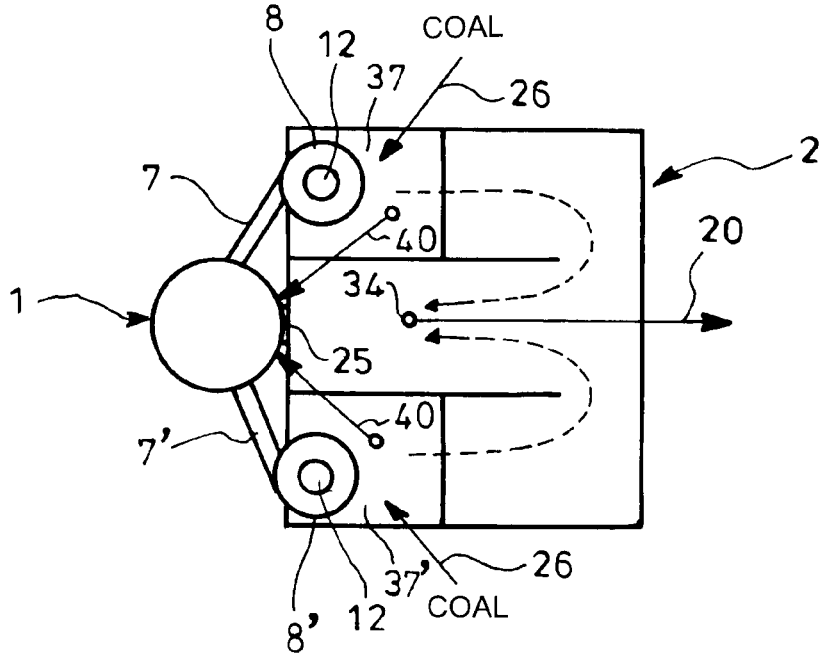
FIG. 14 is a plan view of FIG. 13.

FIGS. 13 and 14 show a still further embodiment of the invention for further appropriate gasification of raw material 26 such as coal. This embodiment is structurally similar to the embodiment of FIGS. 11 and 12, raw material 26 comprising coal being supplied to pretreatment chambers 37 and 37' where the raw material 26 comprising coal is pyrolyzed to take-out pyrolysis gas 40 comprising volatile components. The pretreated raw material 41 pyrolyzed in the pretreatment chambers 37 and 37' and free from the volatile components is passed blow the baffle means 36 and 36' for guidance through the circuitous flow passages 33 and 33', so that the pretreated raw material 41 undergoes satisfactory aqueous gasification reaction during its movement in the circuitous flow passages 33 and 33' and therefore good produced gas 20 with reduced tar can be taken out.

On the other hand, the pyrolysis gas 40 produced in the pretreatment chambers 37 and 37' is supplied to the fluidized bed combustion furnace 1 for heating of the bed material, so that the temperature of the bed material can be increased, which makes it possible to supply more raw material 26 to the fluidized bed gasification furnace 2 to increase production amount of the produced gas 20.

The description has been made on the cylindrical fluidized bed combustion furnace; however, the furnace may be of any shape. The gasified gas take-out port may be provided anywhere on the top of the fluidized bed gasification furnace.

INDUSTRIAL APPLICABILITY

A fluidized bed gasification system of the invention makes it possible to cause unburned char from various kinds of raw material to flow throughout a fluidized bed gasification furnace, thereby attaining gasification with higher efficiency.

The invention claimed is:

1. A fluidized bed gasification system comprising a fluidized bed combustion furnace for heating of bed material through combustion of char, a separator for separating bed material from hot fluid from the fluidized bed combustion furnace, a fluidized bed gasification furnace into which raw material is introduced and the bed material separated in the separator is introduced via a downcomer, the raw material being gasified by means of a fluidized bed supplied with a gasification agent to take-out produced gas, a supply flow passage for circulating the bed material and char produced upon the gasification of the raw material in the fluidized bed gasification furnace to the fluidized bed combustion furnace, said fluidized bed combustion furnace being arranged adjacent to the fluidized bed gasification furnace so that said downcomer from the separator and said supply flow passage are arranged adjacent to the fluidized bed combustion furnace in a plane of the fluidized bed gasification furnace, the raw material being supplied adjacent to the downcomer from the separator, and movement regulation means for regulating moving direction of the bed material arranged between arranged positions of the downcomer of the separator and of the supply flow passage in the plane of the fluidized bed gasification furnace, whereby the bed material introduced via the downcomer is directed together with the raw material to said supply flow passage via a circuitous flow passage for travel throughout the fluidized bed gasification furnace by the movement regulation means.

2. A fluidized bed gasification system as claimed in claim 1, wherein in the circuitous flow passage, baffle means is arranged to seal a top of the circuitous flow passage and extend at a lower end thereof into the fluidized bed to thereby provide a pretreatment chamber including the downcomer, the raw material being supplied to the pretreatment chamber for pretreatment of the raw material, the pretreated raw material being passed below the baffle means for guidance through the circuitous flow passage.

3. A fluidized bed gasification system as claimed in claim 1, wherein the movement regulation means provides the circuitous flow passage by a heat-resistant partition extending longitudinally in the fluidized bed gasification furnace to partition the fluidized bed.

4. A fluidized bed gasification system as claimed in claim 2, wherein the movement regulation means provides the circuitous flow passage by a heat-resistant partition extending longitudinally in the fluidized bed gasification furnace to partition the fluidized bed.

5. A fluidized bed gasification system as claimed in claim 1, wherein the movement regulation means provides the circuitous flow passage by a concavity provided by partly concaving an outer wall of the fluidized bed gasification furnace into the plane of the fluidized bed gasification furnace.

6. A fluidized bed gasification system as claimed in claim 2, wherein the movement regulation means provides the circuitous flow passage by a concavity provided by partly concaving an outer wall of the fluidized bed gasification furnace into the plane of the fluidized bed gasification furnace.

7. A fluidized bed gasification system as claimed in claim 1, wherein a downstream portion of the circuitous flow passage adjacent to the supply flow passage is provided with a produced gas take-out port.

8. A fluidized bed gasification system as claimed in claim 2, wherein a downstream portion of the circuitous flow passage adjacent to the supply flow passage is provided with a produced gas take-out port.

9. A fluidized bed gasification system as claimed in claim 1, wherein a single fluidized bed combustion furnace is provided with a single separator.

10. A fluidized bed gasification system as claimed in claim 2, wherein a single fluidized bed combustion furnace is provided with a single separator.

11. A fluidized bed gasification system as claimed in claim 1, wherein a single fluidized bed combustion furnace is provided with a plurality of separators.

12. A fluidized bed gasification system as claimed in claim 2, wherein a single fluidized bed combustion furnace is provided with a plurality of separators.

13. A fluidized bed gasification system as claimed in claim 2, wherein the raw material is dehydrated in the pretreatment chamber to take-out steam.

14. A fluidized bed gasification system as claimed in claim 2, wherein the raw material is pyrolyzed in the pretreatment chamber to take-out pyrolysis gas.

15. A fluidized bed gasification system as claimed in claim 14, wherein the pyrolysis gas taken out from the pretreatment chamber is supplied as fuel for heating to the fluidized bed combustion furnace.

* * * * *